US009309689B2

(12) United States Patent
Fier

(10) Patent No.: US 9,309,689 B2
(45) Date of Patent: Apr. 12, 2016

(54) BREATHABLE GARMENT

(71) Applicant: Alyx Fier, Seattle, WA (US)

(72) Inventor: Alyx Fier, Seattle, WA (US)

( * ) Notice: Subject to any disclaimer, the term of this patent is extended or adjusted under 35 U.S.C. 154(b) by 288 days.

(21) Appl. No.: 13/961,694

(22) Filed: Aug. 7, 2013

(65) Prior Publication Data

US 2014/0259268 A1 Sep. 18, 2014

Related U.S. Application Data

(63) Continuation-in-part of application No. 13/835,272, filed on Mar. 15, 2013.

(51) Int. Cl.

| | |
|---|---|
| ***E04H 15/16*** | (2006.01) |
| ***A41D 1/06*** | (2006.01) |
| ***A41D 27/28*** | (2006.01) |
| ***A41D 3/04*** | (2006.01) |
| ***A41D 27/02*** | (2006.01) |
| *F24F 7/02* | (2006.01) |

(52) U.S. Cl.

CPC *E04H 15/16* (2013.01); *A41D 1/06* (2013.01); *A41D 3/04* (2013.01); *A41D 27/02* (2013.01); *A41D 27/28* (2013.01); *F24F 7/02* (2013.01)

(58) Field of Classification Search

CPC ..... A41D 27/28; F24F 7/02
USPC ..... 2/69, 85, 87, 227, DIG. 1, DIG. 5
See application file for complete search history.

(56) References Cited

U.S. PATENT DOCUMENTS

| | | | | |
|---|---|---|---|---|
| 3,296,626 | A * | 1/1967 | Ludwikowski | 2/87 |
| 4,184,414 | A * | 1/1980 | Jarnot | 454/275 |
| 4,270,227 | A | 6/1981 | Wolfe | |
| 4,576,087 | A | 3/1986 | Wolfe | |
| 2011/0239350 | A1 * | 10/2011 | Ho et al. | 2/93 |
| 2013/0178146 | A1 | 7/2013 | Stockett | |

FOREIGN PATENT DOCUMENTS

| | | |
|---|---|---|
| CN | 201349559 | 11/2009 |
| JP | H0931728 | 2/1997 |

* cited by examiner

*Primary Examiner* — Khaled Annis

(74) *Attorney, Agent, or Firm* — Darren J. Jones; Lowe Graham Jones PLLC

(57) ABSTRACT

A method for creating rainwear that is waterproof yet allows the body's heat and moisture to vent is disclosed, including a shell and a liner, wherein the shell material is waterproof, and the liner material is waterproof and may or may not be breathable and vents placed at intervals in the fabric of the liner that allow for free air flow between the interior and exterior of the garment to achieve breathability by virtue of the vents. The garment may be made of materials that are inherently flame resistant for use where there is a danger of flash fire, such as high-voltage electrical work and petroleum production. In some embodiments, vents are inserted within apertures defined by a garment and include a base with inner and outer ridges surrounding a central opening and a cover having a perimeter extending between the inner and outer ridges.

18 Claims, 14 Drawing Sheets

BREATHABLE GARMENT

PRIORITY CLAIM

The application is a continuation-in-part of U.S. application Ser. No. 13/835,272, filed Mar. 15, 2013, and entitled BREATHABLE GARMENT, which is hereby incorporated herein by reference in its entirety.

FIELD OF THE INVENTION

The invention relates to windproof and waterproof clothing when used by persons who are engaged in active pursuits, such as those involving either work or recreation. Specifically this invention relates to a method for protecting persons from the negative effects of wind or rain, while simultaneously providing means for the hot, moist air generated by their body to vent to the exterior of their clothes so that the vapor doesn't condense inside their clothes and make them wet. This problem has been recognized and ventilation systems have been created for clothing that can be opened by various means such as zippers, however in the event of rain these vents must be closed to prevent water from entering into the clothing from the outside and then the moist air created by the body condenses on the interior of the clothing.

BACKGROUND OF THE INVENTION

Waterproof clothing has until the present time been constructed either from coated fabric such that it is absolutely windproof and waterproof, or from fabric with a membrane that keeps water (such as rain) from penetrating the fabric from the exterior but which is, to some degree, permeable to vapor such as that created by the human body under exertion. However, neither material allows substantial amounts of heat or moisture to move from the interior to the exterior of clothing constructed from the material. The result is that heat and moisture will accumulate within a very short time when the user is active. This in turn results in overheating, a drop in performance, and the wearer becoming wet from moisture condensing inside the clothing. Conversely in a colder environment, the wearer sweats during active times then the dampness remaining on the wearer's body over chills the body during rest periods. The term clothing as used in the description of the present invention relates to jackets, trousers, shirts, and headgear.

Other methods have been developed to allow for the venting of wind and waterproof clothing while preventing the intrusion of rain. U.S. Pat. No. 7,043,767 to Jaeger discloses a ventilation system for clothing utilizing a shingled construction. However, this system is expensive to construct and is very limited in the range of materials that can be used.

Similarly, Japanese Patent No. 2008038323 Fukuyama Teruyoshi discloses a similar shingled construction to create ventilation, but suffers from the same drawbacks as Jaeger.

Another method of allowing for ventilation while preventing rain from penetrating is US Patent Application Publication No. 2010/0242149 to Mickle et al., which discloses a series of vents using spacer materials as baffles to allow air flow while keeping rain water out. This approach, however, is expensive to construct, can only use a limited range of materials and is bulky.

The prior-art techniques attempt to prevent the intrusion of water while allowing for the venting of vapor. But the prior methods have a number of disadvantages: a) the construction costs of creating the vents using elaborate combinations of materials are prohibitive; b) the shingled construction with multiple layers of materials creates added bulk that feels awkward and constrains movement; c) the amount of air flow through the vents is limited by the various meshes it has to pass through; and d) the designs limit the range of materials that can used to create the clothing.

SUMMARY OF THE INVENTION

The present disclosure relates to windproof and waterproof clothing for use by persons who are engaged in active pursuits involving either work or recreation as well as other applications in which both waterproofing and breathability are important. In particular, the present disclosure is related to an apparatus including at least one panel defining one or more apertures and including a flexible material. One or more vent assemblies are secured to the at least one panel for each aperture of the one or more apertures. Each vent assembly includes a base portion secured to the at least one panel and defining an opening overlapping the each aperture. An outer ridge is secured to the base portion and an inner ridge secured to the base portion, the inner ridge being encircled by the outer ridge. A cap is secured to the base portion and has an outer perimeter positioned between the inner ridge and the outer ridge, the cap, inner ridge, and outer ridge defining a channel in fluid communication with the opening. The base may include a flange for bonding to the panel.

In some embodiments, the outer ridge defines one or more notches, which may be non-uniformly distributed around the outer ridge. The outer ridge may extend outwardly from the base more than the inner ridge. The perimeter of the cap may be offset from the base a distance less than the extent of the outer ridge outwardly from the base.

In some embodiments, the base defines a plurality of receptacles and the cap has a plurality of posts secured thereto and sized to insert within the receptacles. The end portions of the plurality of posts may include a widened portion configured to resist removal of the end portions from the receptacles.

BRIEF DESCRIPTION OF THE DRAWINGS

Preferred and alternative embodiments of the present invention are described in detail below with reference to the following drawings. These depict particular embodiments of the invention and are not intended to limit the scope of the invention set forth in the claims.

DETAILED DESCRIPTION OF THE PREFERRED EMBODIMENTS

Figure 1:
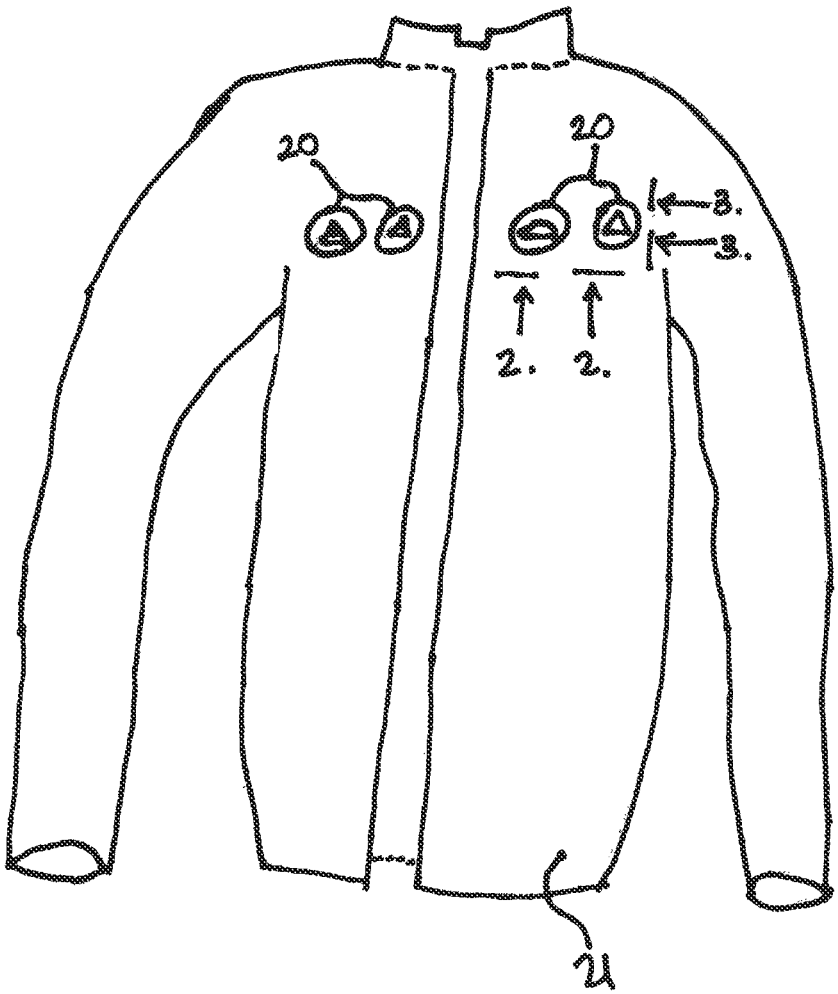
FIG. 1 shows a front view of the liner portion with molded synthetic fittings in the front panels of the jacket.
Figure 2:
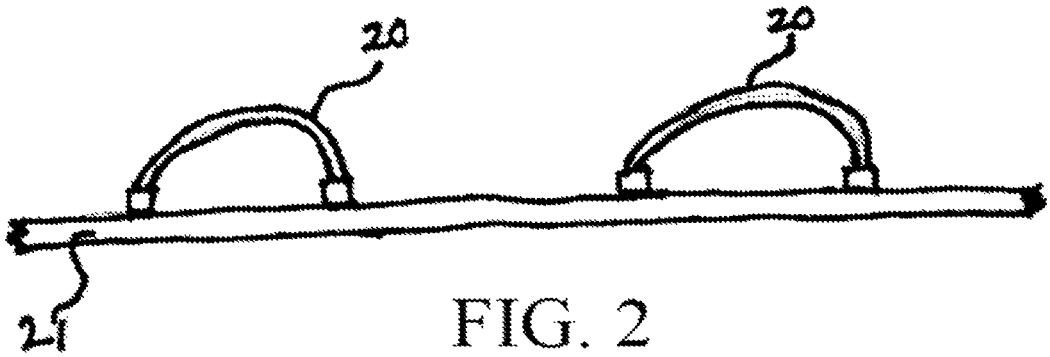
FIG. 2 is a view of the molded vent openings as seen from below showing how they create an arch, which allows air to flow from the interior to the exterior of the liner.
Figure 3:
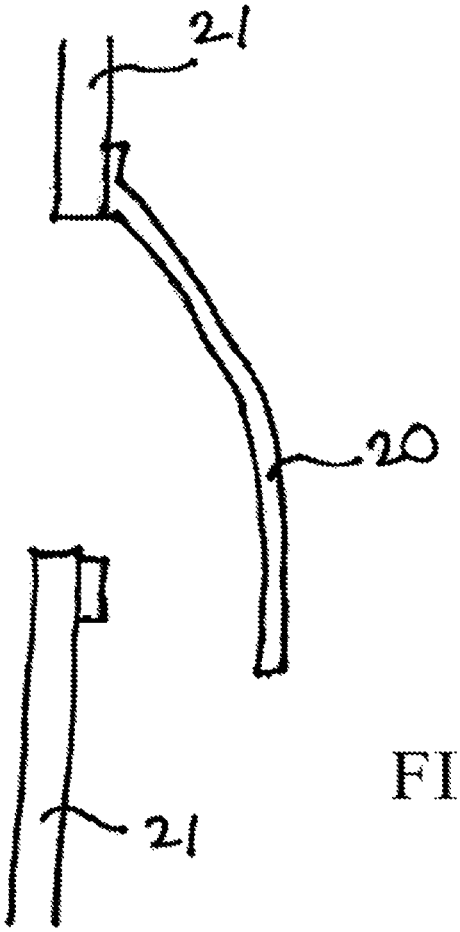
FIG. 3 is a section view of the molded vent opening showing how it protects the opening from water intrusion while still allowing air to flow from the interior to the exterior of the liner.

A preferred embodiment of the method of the present invention is illustrated in FIG. 1 which shows the liner 21 of a jacket with vents 20 set into the fabric of the anterior upper-thorax region wherein the materials used in the construction may be inherently flame resistant such as Nomex, FR (Flame Resistant) Modacrylic, FR Urethane and FR Vinyl. FIG. 2 shows a view from below of the opening of the vent 20, which will allow for the movement of warm moist air away from the body. FIG. 3 shows a section view of vent 20 showing how the vent includes a vent hood affixed to the material of the jacket liner such that it surrounds a hole in the liner such that air can escape but water is prevented from entering.

Figure 4:
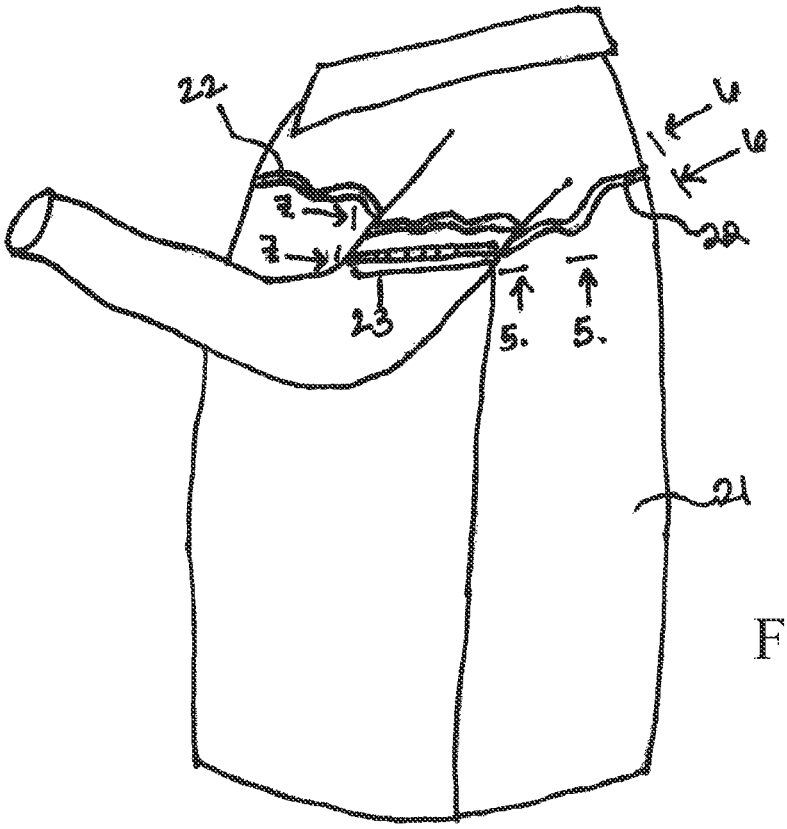
FIG. 4 shows a side view of the liner portion with vents in the front and rear of the jacket, as well as on the sleeve.

FIG. 4 shows another embodiment of the method for creating a series of vents 22 in the liner portion of the current invention utilizing a series of shingle-like, over-lapping panels of fabric arranged so that water running down will fall from panel to panel until reaching the lower hem of the garment. For purposes of illustration, only a single row of vents 22 are shown; however, any number of rows of vents 22 can be included. In addition, the vents 22 are not necessarily in rows, but rather can be arranged individually in any suitable pattern or in an arbitrary pattern. The fabric panels are joined together at intervals allowing gaps in the seams that will allow airflow to carry hot, moist air away from the user's body. The material of the fabric panels itself may not be breathable; however, by virtue of the vents the hot, moist air is permitted to exit the garment and therefore achieve breathability.

Figure 5:
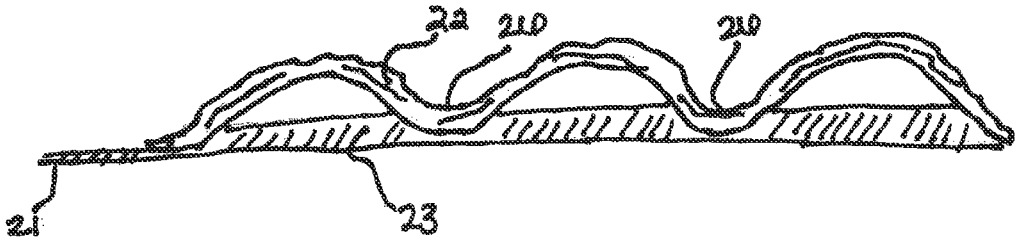
FIG. 5 is a view of the vents created by a piece of fabric with a stiffened edge tacked down in a manner that creates a series of arches to allow airflow.

FIG. 5 shows a view of the vent 22 from below showing how the vent panel 22 is fastened. A sewn construction is utilized that is later sealed against water intrusion. Alternatively the vent panel 22 is fastened with Radio Frequency welding methods 26 at intervals to the liner 21. Preferably, a dam portion 23 is also employed, which prevents water from moving up and through the vent.

Figure 6:
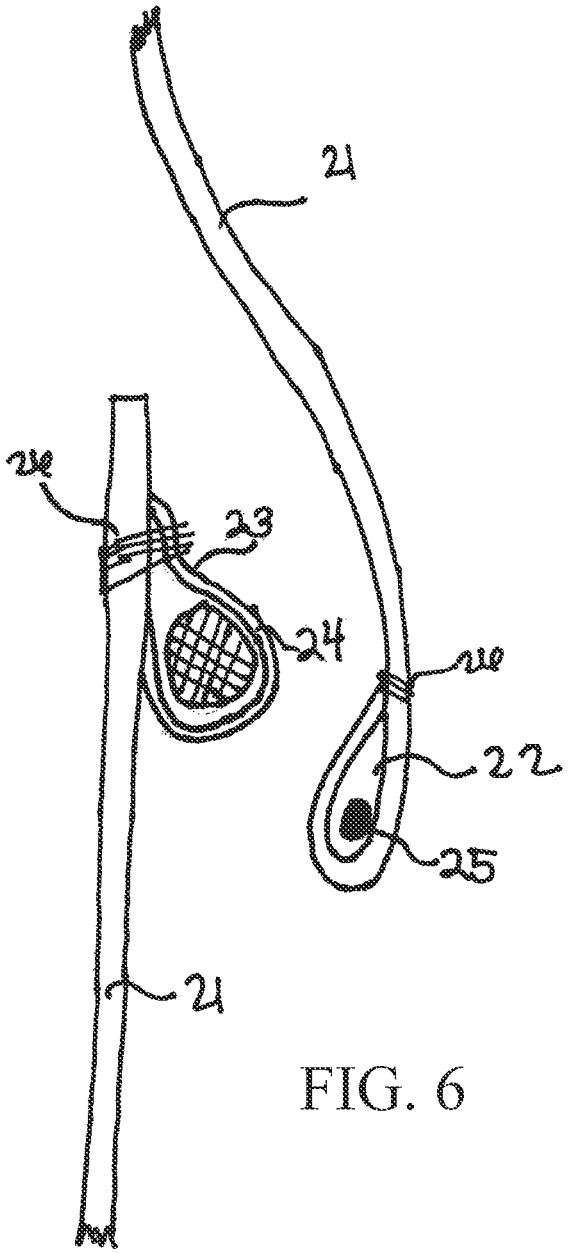
FIG. 6 is a section view of the overlapping fabric panels with the upper panel having a stiffened edge, and the lower panel having a raised dam portion on the interior of the opening.
Figure 7:
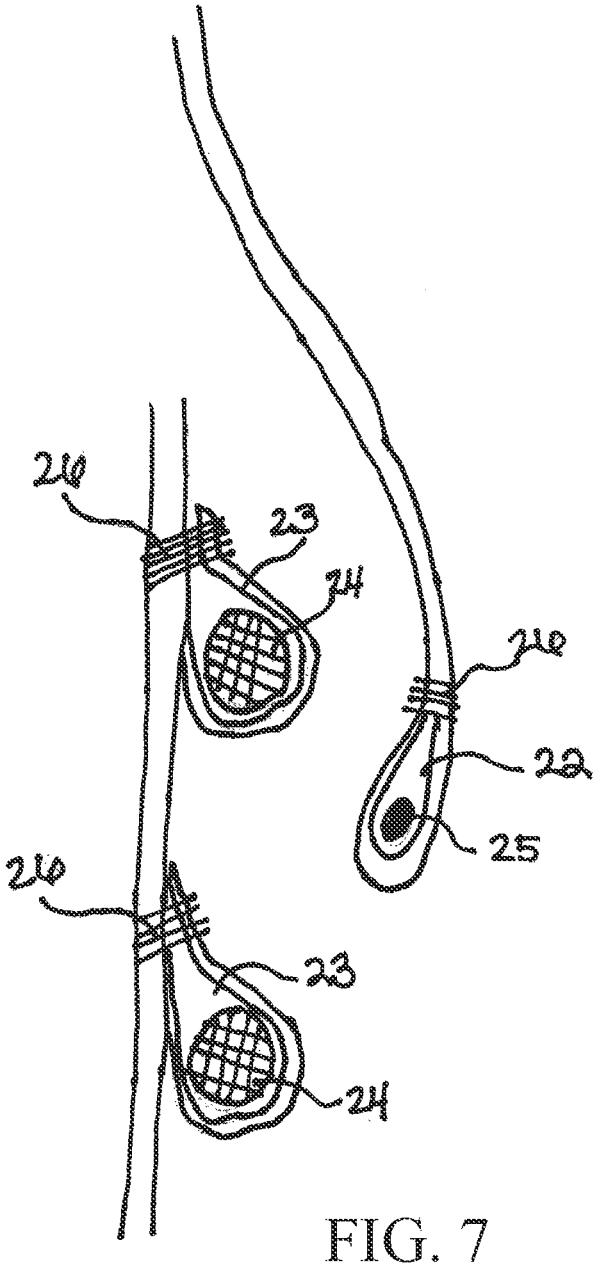
FIG. 7 is a section view of the overlapping fabric panels on the sleeve with the upper panel having a stiffened edge, and the lower panel having a raised dam portion on interior of the opening, with an additional dam portion on the exterior of the opening.

FIG. 6 shows a cross sectional view of the construction details of the vent 22 with the core stiffening element 25 and the placement and construction of the dam 23 with its core element 24. FIG. 7 shows the same cross section view as FIG. 6 with the addition of a second dam portion 23 placed outside of the vent 22 to provide additional protection from water moving into and through the vent opening.

Figure 8:
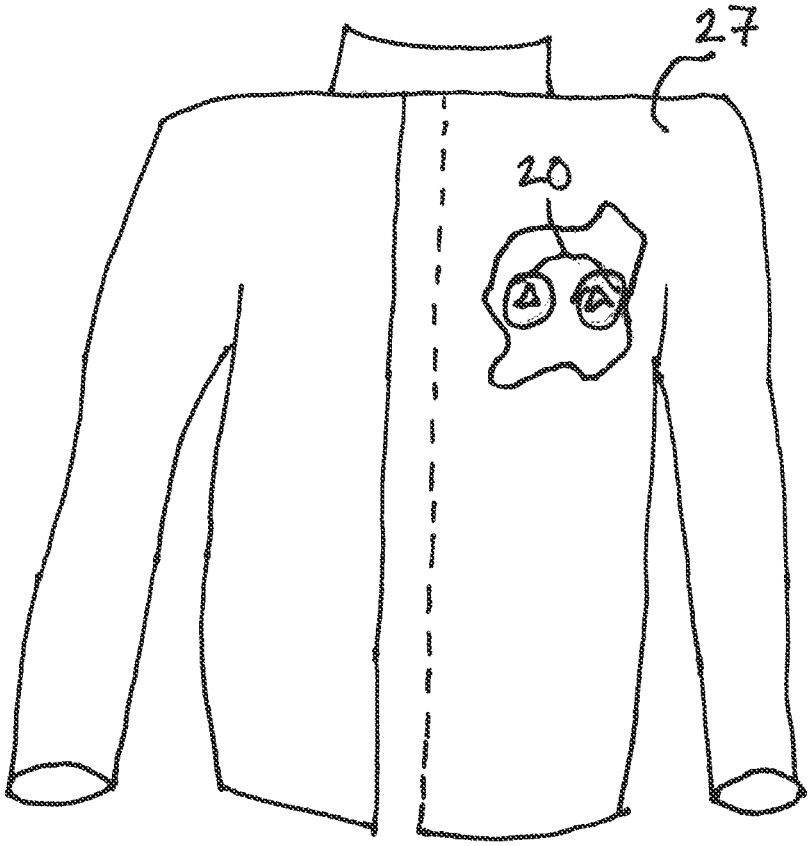
FIG. 8 is a cut away view of the front panels of the shell portion of the jacket showing the liner portion with the molded synthetic fittings.
Figure 9:
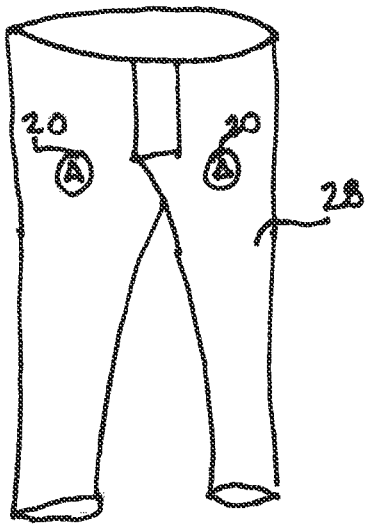
FIG. 9 shows a front view of the liner portion of the trousers with the molded synthetic fittings in the front panels.
Figure 10:
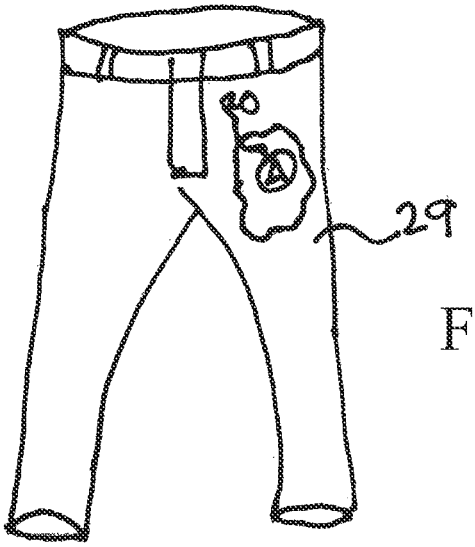
FIG. 10 is a cut away view of the front panels of the shell portion of the trousers showing the liner portion with the molded synthetic fittings.

FIG. 8 shows a cut-away view of the shell portion 27 of the jacket revealing the vents 20 in the liner portion 21 of the jacket. FIG. 9 shows the liner 28 of a pair of trousers with vents 20 set into the fabric of the anterior upper-thigh region. FIG. 10 shows a cut-away view of the shell portion 29 of the pair of trousers revealing the vents 20 in the liner portion 21 of the trousers.

Figure 11A:
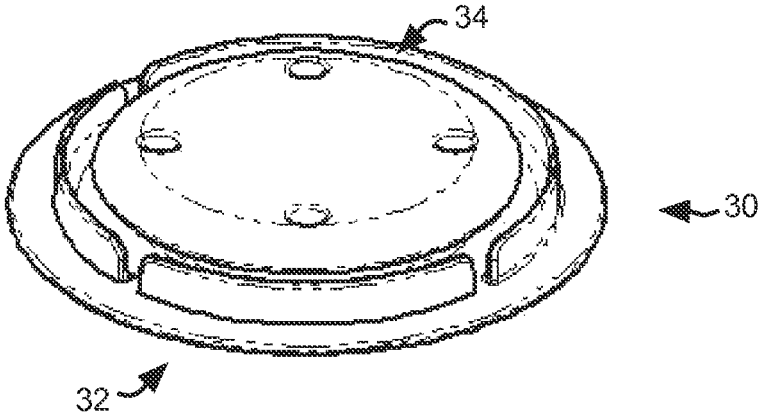
FIGS. 11A and 11B are upper and lower isometric views of a vent assembly in accordance with an embodiment of the present invention.
Figure 11B:
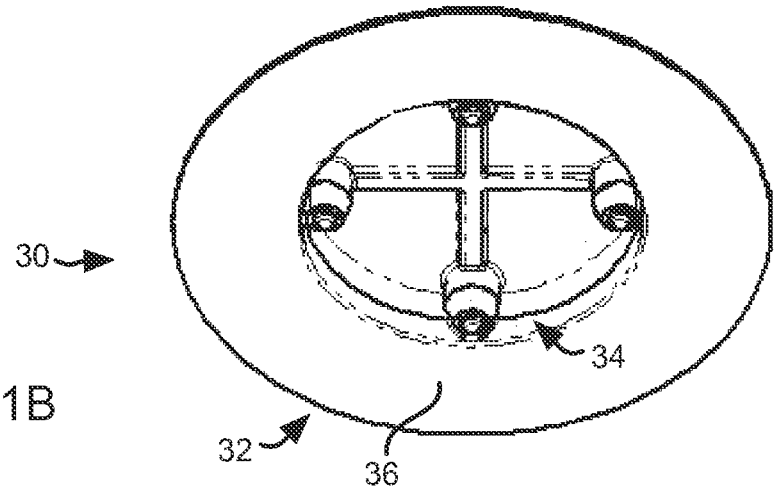

FIGS. 11A and 11B illustrate a vent assembly 30 that may be used to provide breathability for a garment or in other applications. The vent assembly 30 may include an upper portion 34 and a lower portion 32. The lower portion 32 may define a base plate 36 having a generally planar shape. The vent assembly 30 may secure to a garment or some other device by means of the base plate 36.

Figure 12A:
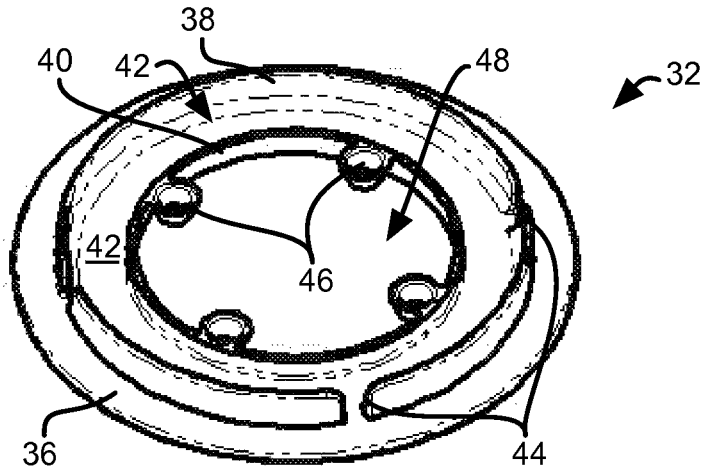
FIGS. 12A and 12B are upper and lower isometric views of a base portion of a vent assembly in accordance with an embodiment of the present invention.
Figure 12B:
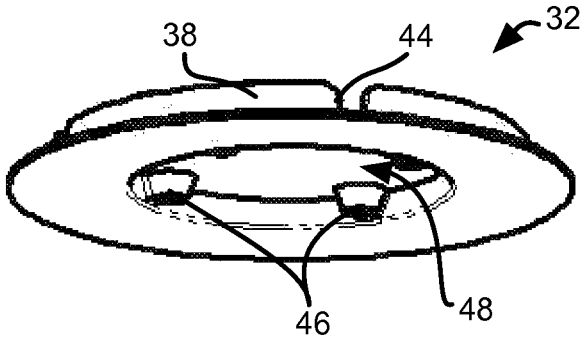

FIG. 12A and FIG. 12B illustrate the base portion 32 of the vent assembly 30. The base portion 32 may define an outer ridge 38 and an inner ridge 40. The outer ridge 38 encircles the inner ridge 40. The ridges 38, 40 may be separated from one another by a gutter portion 42. The ridges 38, 40 extend outwardly from the base plate 16 in the same direction and to a greater extent than the gutter portion 42. The gutter portion 42 may be defined as a portion of the base plate 36 positioned between the ridges 38, 40. In the illustrated embodiment, the ridges 38, 40 and base plate 36 all have a circular perimeter shape. However, other perimeter shapes may also be used. In the illustrated embodiment, the outer ridge 38 defines one or more grooves 44 to facilitate drainage of fluids that may collect in the gutter portion 42. The grooves 44 may be distributed non-uniformly around the outer ridge 38. For example, the grooves 44 may only be present in one half of the outer ridge 38. In this manner the un-grooved portion of the outer ridge 38 may be positioned vertically above the grooved portion thereby allowing water to drain from the gutter portion 42 but hindering falling water from entering the gutter portion 42.

As will be described in greater detail below, the upper portion 34 may mount to the lower portion by means of receivers 46 secured to the base plate 36. The receivers 46, outer ridge 38, and inner ridge 40 may be disposed about an aperture 48 defined by the base plate 36. The aperture 48 is preferably large, e.g. have a diameter larger than 50%, preferably larger than 75%, of the diameter of the outer ridge 38. In the illustrated embodiment, the outer ridge 38 and inner ridge 40 are concentric with each other and the aperture 48 and the receivers 46 protrude into the aperture 48. However, other configurations may also be used, including eccentric configurations.

Figure 13A:
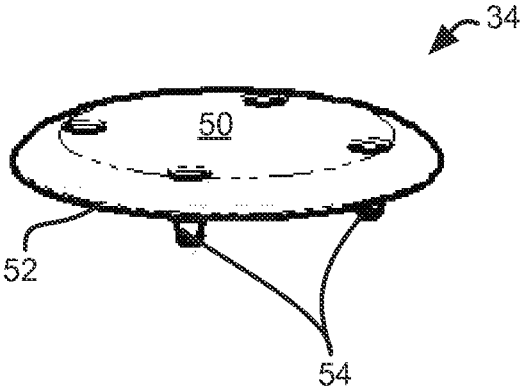
FIGS. 13A and 13B are upper and lower isometric views of an upper portion of a vent assembly in accordance with an embodiment of the present invention.
Figure 13B:
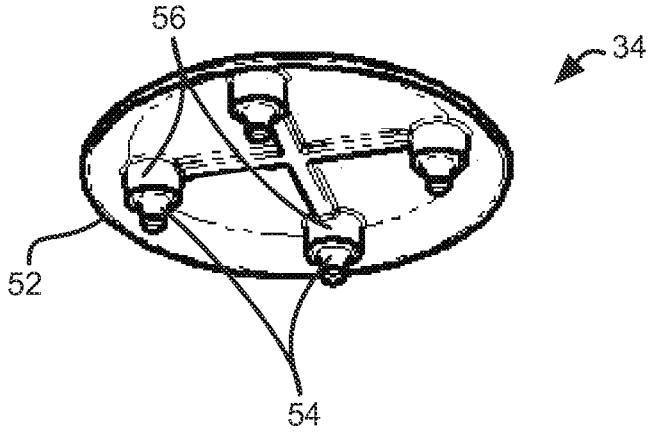

FIG. 13A and FIG. 13B illustrate the upper portion 34 of the vent assembly 30. The upper portion 34 may define an outer cover 50 that provides a continuous waterpoof area within a perimeter 52. The cover 50 may have posts 54 or some other fastening structure extending from a lower surface thereof to enable securement of the cover 50 to the base portion 32. The posts 54 may protrude from the outer cover 50 or from pedestals 56 or some other structure secured to a lower surface of the cover 50.

Figure 14:
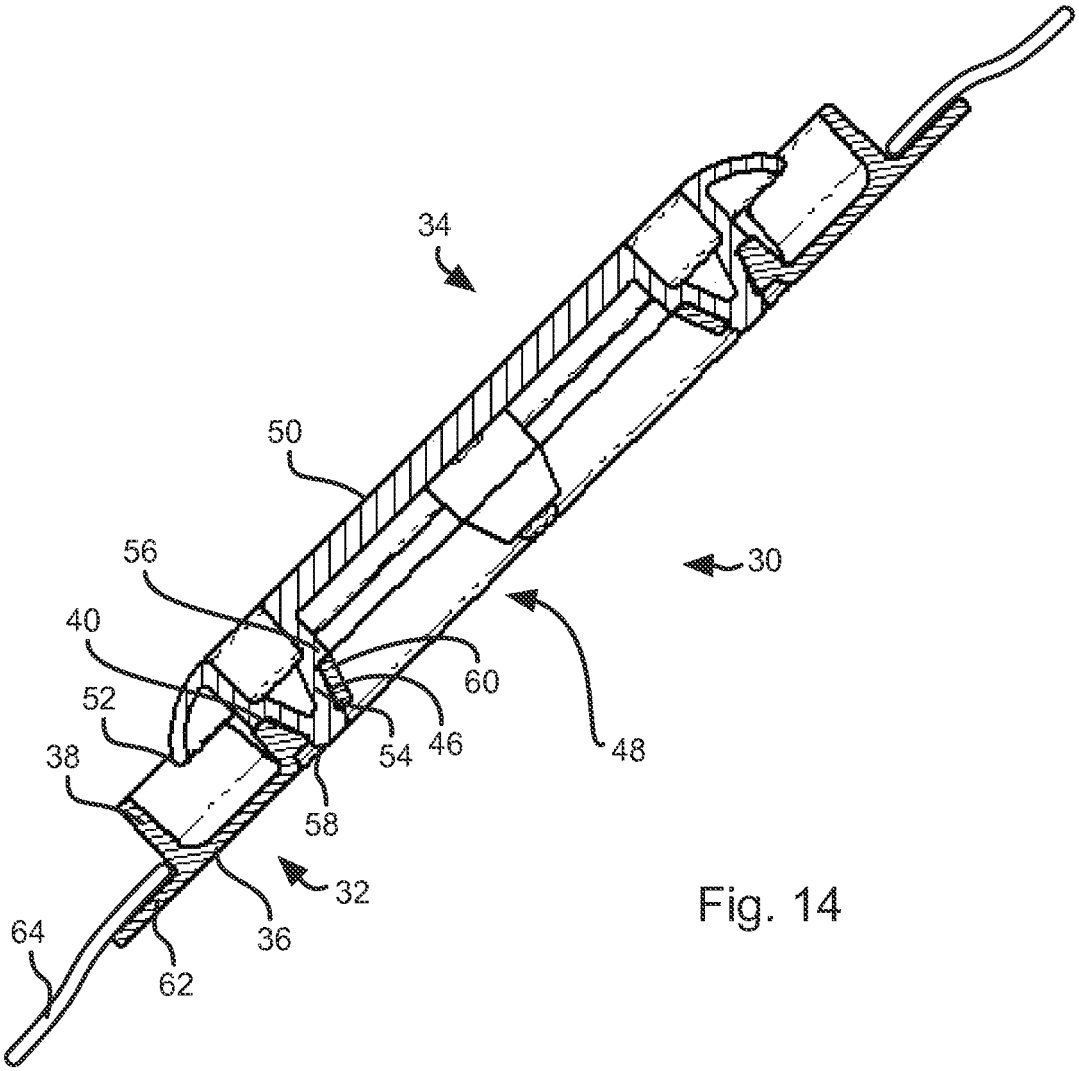
FIG. 14 is a side cross-sectional view of a vent assembly in accordance with an embodiment of the present invention.

Referring to FIG. 14, in the illustrated embodiment, the posts 54 may be inserted into the receivers 46 in order to fasten the upper portion 34 to the lower portion 32. The posts 54 may be secured within the receivers 56 by means of adhesives, an interference fit, or some other means. In the illustrated embodiment, the posts 54 have a widened distal portion 58. During insertion one or both of the distal portion 58 and the receiver 46 may elastically deform. When the distal portion 58 emerges from the receiver 46, one or both of the distal portion 58 and receiver 46 may elastically return to approximately their original dimensions such that the widened distal portion 58 will resist removal of the posts 54 from wtihin the receivers 46. In the illustrated embodiment, the receivers 46 have a tapered, e.g. conical, shape to facilitate insertion of the widened portion. The receivers 46 may be formed in a member 60 that protrudes into the aperture 48. When the posts 54 are inserted within the receivers 46, the pedestals 56 may abut the members 60.

The base plate 36 may define a flange 62 extending radially outward therefrom enabling securement of the vent assembly 30 to a sheet 64 of material defining an aperture for receiving the vent assembly 30. In the illustrated configuration, the flange 62 secures to an inner surface of the sheet 64 and the ridges 38, 40 and cover 50 extend through the sheet 64 and extend outwardly from an outer surface of the sheet 64. However, other configurations are possible. For example, the lower surface of the flange 62, and additionally or alternatively other areas of the base plate 36, could secure to the outer surface of the sheet 64. In such embodiments, the sheet 64 may define an aperture that overlaps with the aperture 48 when the vent assembly is installed.

In any of these configurations, the base plate 36 may secure to the sheet 64 by means of adhesives, stitching, welds (e.g. high frequency or radio frequency welds), or some other bonding technique. The lower portion 32 and upper portion 34 may be formed of a rigid material or a flexible material. For example, where the vent assembly 30 is incorporated into a garment a flexible vent assembly 30 may facilitate movement of the wearer and reduce the likelihood of the vent assembly 30 tearing out of the garment. However, vent assemblies 30 including a rigid or semirigid material may also be suitable for many applications. Even with a rigid material, the vent assembly 30 can function well with a flexible material in a garment, for example. The vents may be small enough that when strategically placed they do not interfere with movement and comfort. The vent assembly 30 may be constructed of vinyl, coated urethane, polyvinyl chloride (PVC), or other polymer materials.

The sheet 64 may be a breathable or non-breathable material. The vent assembly 30 is particularly useful with materials that are waterproof but not breathable inasmuch as these materials are less expensive than breathable materials. The sheet 64 may be a flexible material, however rigid and semirigid materials may also be used as the sheet 64.

Figure 15:
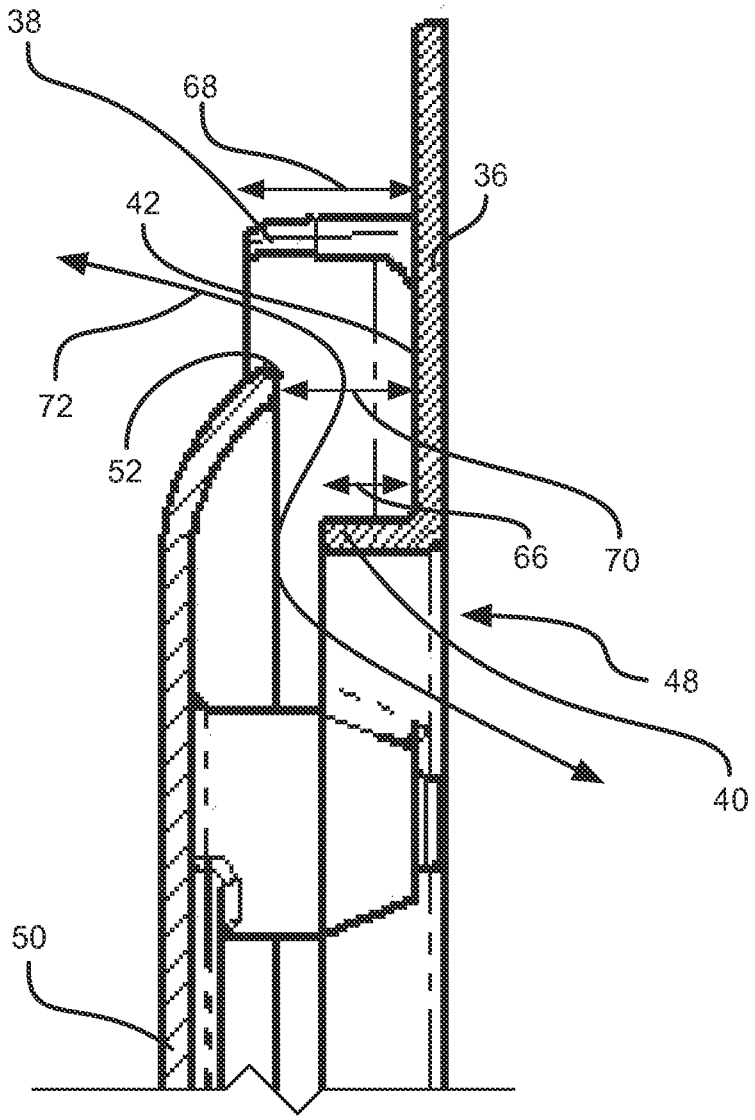
FIG. 15 is a partial side cross-sectional view of a vent assembly in accordance with an embodiment of the present invention.

Referring to FIG. 15, the inner ridge 40 has a height 66, the outer ridge 38 has a height 68, and the perimeter portion 52 of the cover 50 has an offset distance 70 relative to a deepest point of the gutter portion 42. As shown, the height 68 may be greater than the offset distance 70 such that the outer ridge 68 is able to hinder ingress of water under the cover 50. The height 66 of the inner ridge 40 may be such that there is a gap between the lower surface of the cover 50 and the inner ridge 40. There may likewise be a circumferential gap between the perimeter 52 of the cover 30 and the outer ridge 38. In this manner, air flow 72 is permitted through the aperture 48, between the inner ridge 40 and the cover 50, and through the gap between the outer ridge 38 and the perimeter 52.

Figure 16:
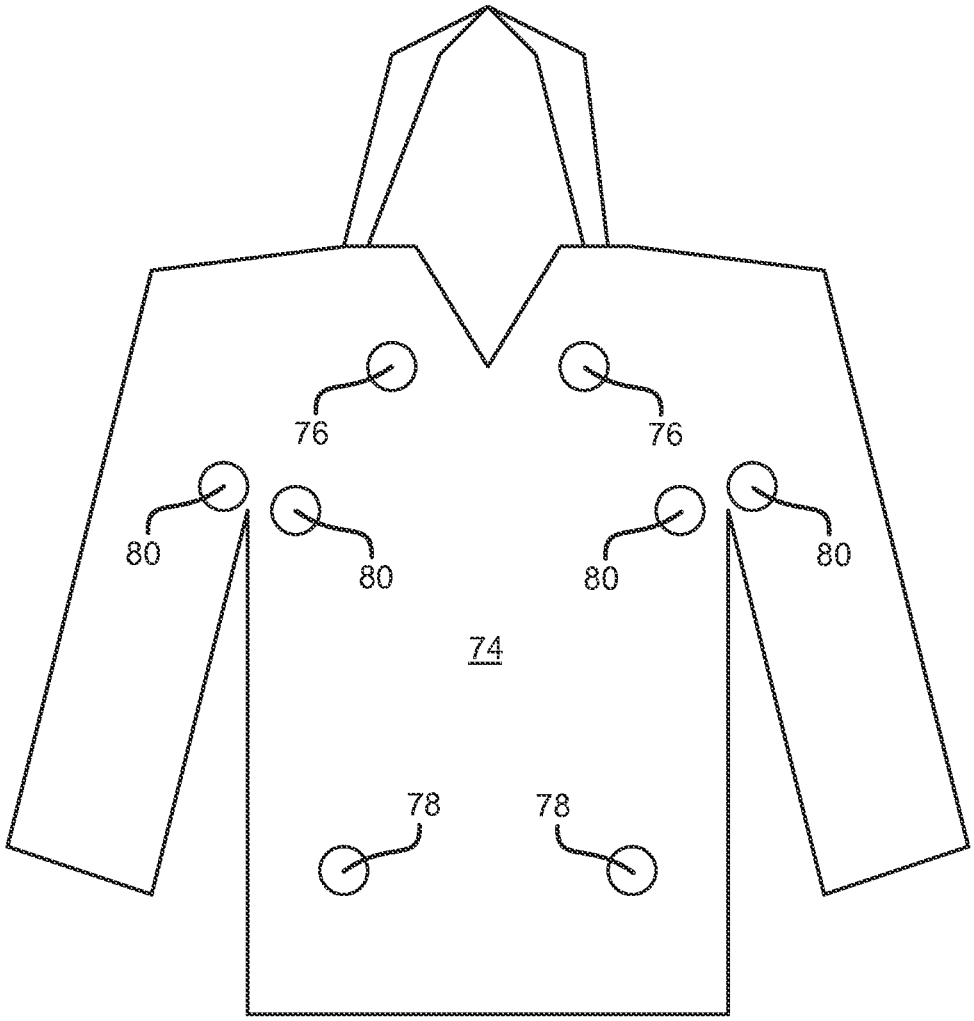
FIG. 16 is a front elevation view of a garment including vent assemblies in accordance with an embodiment of the present invention.

Referring to FIG. 16, a garment 74, such as a jacket, windbreaker, pants, or the like may incorporate vent assemblies 30 as described hereinabove in one or more panels of material forming the garment 74. For example, a garment may include upper vents 76 and lower vents 78 such that the upper vents 76 are higher than the lower vents 78 when the garment 74 is worn by a person standing upright. In this manner, convection will tend to draw air through the lower vents 78 and expel air through the higher vents 76. Vents may be placed at other strategic areas, such as vents 80 placed in the armpit area of the garment 74. As noted herein, each vent 76, 78, 80 may be placed in or over an aperture defined by the panel in which it is placed.

Figure 17:
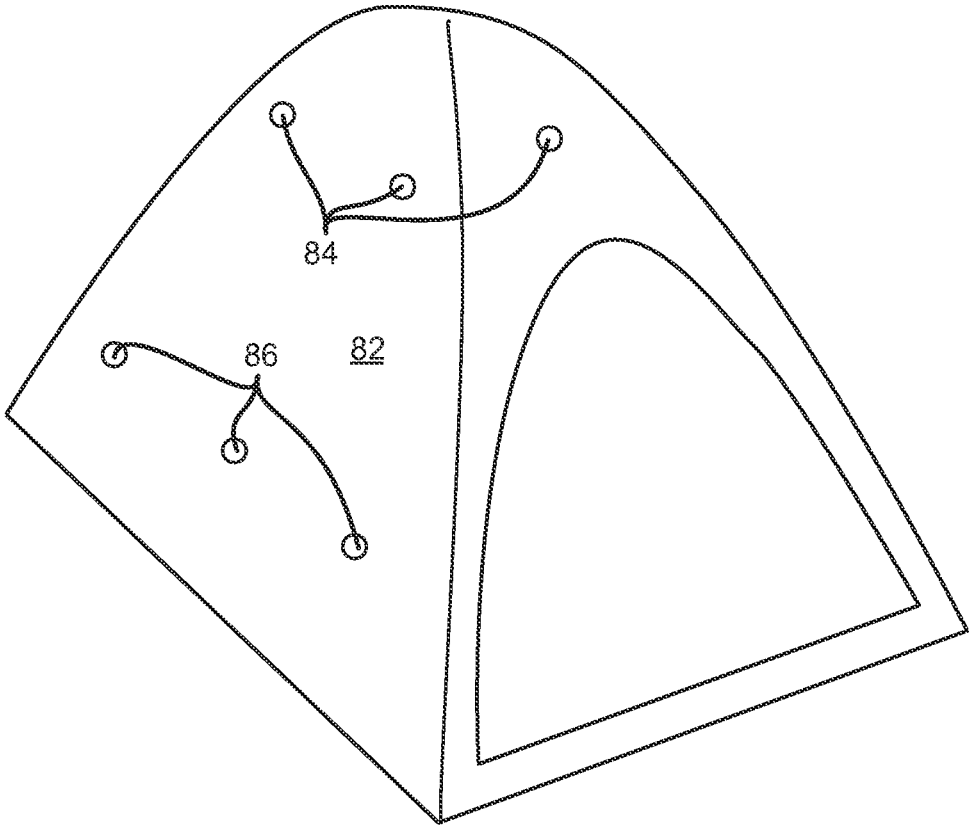
FIG. 17 is an isometric view of a tent including vent assemblies in accordance with an embodiment of the present invention.

Referring to FIG. 17, in other applications, vent assemblies 30 may be incorporated into a tent 82, such as a single-walled tent. In single-walled tents, a single layer of material must provide both a waterproof covering and permit venting for breathing and to reduce condensation on the inner surface of the tent. Accordingly, a panel of the tent 82 may have vents 84, 86 mounted thereto, such as vents 84, 86 embodied as a vent assembly 30 described herein. As for the embodiment of FIG. 16, the tent 82 may include upper vents 84 and lower vents 86 positioned such that the upper vents 84 are vertically above the lower vents 86 when the tent is set up, thereby promoting venting due to convection.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An apparatus comprising:

at least one panel defining one or more apertures and including a flexible material; and one or more vent assemblies secured to the at least one panel for each aperture of at least a portion of the one or more apertures, each vent assembly including a base portion directly secured to the at least one panel and defining an opening overlapping the each aperture;

a ridge directly secured to the base portion, the ridge encircling the each aperture; and a cap directly secured to the base portion and having an outer perimeter extending outwardly from the each aperture, the cap and ridge defining a channel in fluid communication with the opening, the cap defining a continuous surface within the outer perimeter, the continuous surface completely covering the opening;

wherein the base defines a plurality of receptacles and the cap has a plurality of posts secured to an under surface of the cap and extending toward the base and inserted within the receptacles, end portions of the plurality of posts including a widened portion designed to resist removal of the end portions from the receptacles.

2. The apparatus of claim 1, wherein the at least one panel defines a wearable item.

3. The apparatus of claim 2, wherein the one or more apertures include one or more lower apertures and one or more upper apertures, the at least one panel being configured such that the upper apertures are above the lower apertures when the wearable item is worn by a user.

4. The apparatus of claim 2, wherein the wearable item is configured to cover an upper body of a user and the one or more apertures are positioned in an armpit region of the wearable item.

5. The apparatus of claim 1, wherein the at least one panel defines a portion of a tent.

6. The apparatus of claim 5, wherein the tent is a single wall tent.

7. The apparatus of claim 1, wherein the ridge is an outer ridge encircling the outer perimeter of the cap.

8. The apparatus of claim 7, wherein the outer ridge defines one or more notches.

9. The apparatus of claim 7, further comprising an inner ridge secured to the base plate, the outer ridge and outer perimeter of the cap encircling the inner ridge.

10. The apparatus of claim 9, wherein the outer ridge extends outwardly from the base more than the inner ridge.

11. The apparatus of claim 7, wherein the outer perimeter of the cap is offset from the base a distance less than an extent of the outer ridge outwardly from the base.

12. The apparatus of claim 1, wherein the at least one panel includes a waterproof and non-breathable material.

13. The apparatus of claim 1, wherein the base defines a flange extending outwardly from the outer ridge, the flange being bonded to the at least one panel.

14. A vent assembly comprising:

a base portion configured to directly secure to a panel of flexible material overlapping an aperture defined by the panel, the base defining an opening;

an outer ring directly secured to the base portion;

an inner ring directly secured to the base portion, the inner ring being encircled by the outer ring; and a cap directly secured to the base portion and having an outer perimeter positioned between the inner ring and the outer ring, the outer perimeter being circular and the cap having a continuous sheet of material extending within the outer perimeter and completely covering the aperture, the cap, inner ring, and outer ring defining a channel in fluid communication with the opening;

wherein the base defines a plurality of receptacles and the cap has a plurality of posts secured thereto and sized to insert within the receptacles, the receptacles and posts designed to fasten to one another effective to resist removal of the posts from the receptacles.

15. The vent assembly of claim 14, wherein the outer ring defines a plurality of notches distributed non-uniformly around the outer ring.

16. The vent assembly of claim 14, wherein the outer ring extends outwardly from the base more than the inner ring.

17. The vent assembly of claim 16, wherein the outer perimeter of the cap is offset from the base a distance less than an extent of the outer ring outwardly from the base.

18. An apparatus comprising:

at least one panel defining one or more apertures and including a flexible material; and one or more vent assemblies secured to the at least one panel for each aperture of the one or more apertures, each vent assembly including a planar base portion directly secured to the at least one panel and defining an opening overlapping the each aperture;

an outer ring directly secured to the base portion and extending outwardly from a first surface thereof by a first amount;

an inner ring directly secured to the base portion and extending outwardly from the first surface by a second amount less than the first amount, the inner ring being encircled by the outer ring; and a cap directly secured to the base portion and defining a perimeter that is offset from the first surface by a third amount that is greater than the second amount and less than the first amount, the inner ring and cap defining a gap, the perimeter being circular and the cap having a sheet of material extending continuously within the perimeter and completely covering the each aperture;

a plurality of receptacles monolithically formed with the base and projecting inwardly from the inner ring into the opening;

wherein the cap includes a plurality of posts monolithically formed therewith and projecting outwardly from a lower surface of the sheet of material, each post of the plurality of posts having a widened distal end portion inserted through one of the receptacles of the plurality of receptacles effective to resist removal of the cap.

* * * * *